US010160628B2

(12) United States Patent
Wells et al.

(10) Patent No.: US 10,160,628 B2
(45) Date of Patent: Dec. 25, 2018

(54) PNEUMATIC LIFTING DEVICE

(71) Applicant: Toyota Motor Engineering & Manufacturing North America, Inc., Erlanger, KY (US)

(72) Inventors: Keith J. Wells, Evansville, IN (US); Robert D. McClain, Haubstadt, IN (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 166 days.

(21) Appl. No.: 15/079,395

(22) Filed: Mar. 24, 2016

(65) Prior Publication Data

US 2017/0275144 A1 Sep. 28, 2017

(51) Int. Cl.

| | |
|---|---|
| ***B66F 11/04*** | (2006.01) |
| ***B66F 7/16*** | (2006.01) |
| ***B66F 9/08*** | (2006.01) |
| ***B66F 3/35*** | (2006.01) |
| ***B66F 7/04*** | (2006.01) |

(52) U.S. Cl.

CPC ..... *B66F 11/04* (2013.01); *B66F 7/16* (2013.01); *B66F 9/08* (2013.01); *B66F 3/35* (2013.01); *B66F 7/04* (2013.01)

(58) Field of Classification Search

CPC .... B66F 3/35; B66F 3/247; B66F 3/30; B66F 7/065; B66F 7/08; B66F 7/0625; B66F 11/04; B66F 7/04; B66F 9/08

See application file for complete search history.

(56) References Cited

U.S. PATENT DOCUMENTS 1,745,959 A * 2/1930 Steiner ..... B66F 3/35 254/93 HP
2,883,003 A * 4/1959 Arnot ..... B66F 9/08 187/226
3,061,045 A * 10/1962 Gunning ..... B66F 9/08 187/226

(Continued)

OTHER PUBLICATIONS

Lift Products, Inc., "SXTLP Stainless Steel Ground Entry Lift Table", Retrieved from the Internet: <https://www.liftproducts.com/lifttables/stainless/sxtlp.html>, Retrieved Dec. 6, 2015, (2 pages).

(Continued)

*Primary Examiner* — Christopher M Koehler
*Assistant Examiner* — Seahee Yoon
(74) *Attorney, Agent, or Firm* — Christopher G. Darrow; Darrow Mustafa PC

(57) ABSTRACT

A pneumatic lifting device includes a base, a first mast attached to the base, and a second mast attached to the base opposite the first mast. The first mast has a first rail extending therealong, and the second mast has a second rail extending therealong. A lift platform is operatively coupled to the base. The platform includes a first pair and a second pair of bearings coupled thereto so as to move in conjunction with the lift platform. The first pair of bearings is operatively coupled to the first rail so as to enable the first pair of bearings to move with respect to the first rail. The second pair of bearings is operatively coupled to the second rail so as to enable the second pair of bearings to move with respect to the second rail.

12 Claims, 8 Drawing Sheets

(56) References Cited

U.S. PATENT DOCUMENTS 3,172,501 A * 3/1965 Ramer ..... B66F 7/04 187/213
3,174,722 A * 3/1965 Alm ..... B66F 7/0625 108/147
3,344,890 A * 10/1967 Loef ..... B66F 9/08 187/229
3,414,086 A * 12/1968 Ulinski ..... B66F 9/08 187/230
3,682,431 A * 8/1972 Vivian ..... A47C 7/14 248/631
3,774,726 A * 11/1973 Bredberg ..... B66F 9/20 187/223
4,015,686 A * 4/1977 Bushnell, Jr. ..... B66F 11/04 182/112
4,087,895 A * 5/1978 Etienne ..... B60K 1/04 254/93 HP
4,124,104 A * 11/1978 Yarris ..... B66F 9/08 187/238
4,458,785 A * 7/1984 Bushnell, Jr. ..... B66F 9/08 182/145
4,619,346 A * 10/1986 Deguerry ..... B66F 11/04 182/141
4,709,786 A * 12/1987 David ..... B66F 9/10 187/226
5,111,907 A * 5/1992 Kishi ..... B66F 11/04 182/116
5,121,900 A * 6/1992 McDonald ..... B66F 3/35 254/2 R
5,850,892 A * 12/1998 Citron ..... B66F 11/04 182/148
6,257,371 B1 * 7/2001 Wanner ..... B66F 7/20 187/204
6,269,913 B1 * 8/2001 Kollmannsberger ..... B66F 9/06 187/222
8,366,123 B2 * 2/2013 Horstman ..... B66F 5/04 280/47.41
9,302,543 B1 * 4/2016 Pierce ..... B60B 30/10
2005/0110232 A1 * 5/2005 DiBenedetto ..... B62B 1/14 280/47.29
2007/0017746 A1 * 1/2007 Robbin ..... B66F 7/02 187/203
2010/0181147 A1 * 7/2010 Simpson ..... B66F 9/08 187/230
2012/0068425 A1 * 3/2012 Horstman ..... B66F 5/04 280/62
2013/0056693 A1 * 3/2013 Stevens ..... B66F 3/35 254/2 R
2014/0008151 A1 * 1/2014 Solhjem ..... B66F 11/04 182/141
2014/0378279 A1 12/2014 Park et al.

OTHER PUBLICATIONS

Lift-Tables, "Presto AX Pneumatic Scissor Lifts", Retrieved from the Internet: <https://www.lift-tables.net/presto/ax.php>, Retrieved Dec. 6, 2015, (1 page).

* cited by examiner

FIG. 8A
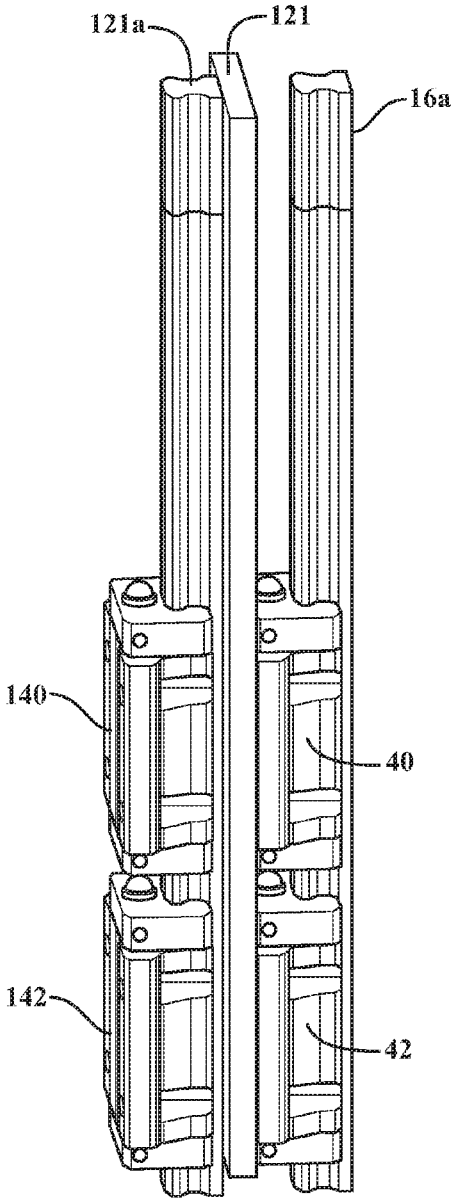
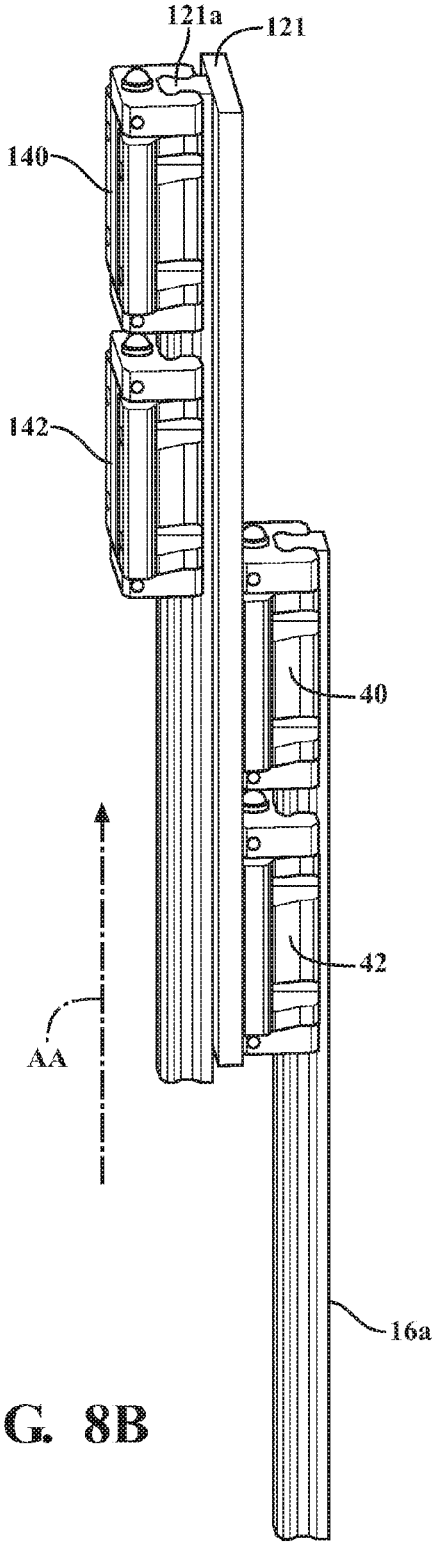
FIG. 8B

PNEUMATIC LIFTING DEVICE

TECHNICAL FIELD

Aspects of the disclosure generally relate to devices used for lifting or elevating a worker or a workpiece to a desired height.

BACKGROUND

Lifting devices have been constructed for a variety of different uses, such as lifting object or workers to a desired height. Some designs include lift tables having a scissor-type frame supporting a lifting surface, and lifting devices which use pistons to raise a lifting surface. However, such designs may be heavy, bulky and difficult to move easily. Also, the operating dimensions of the piston in piston-type designs may severely limit the range of stroke lengths and platform working heights achievable with a single lift platform.

SUMMARY

In one aspect of the embodiments described herein, a pneumatic lifting device is provided. The device includes a base, a first mast attached to the base, and a second mast attached to the base opposite the first mast. The first mast has a first rail extending therealong, and the second mast has a second rail extending therealong. A lift platform is operatively coupled to the base. The platform includes a first pair and a second pair of bearings coupled thereto so as to move in conjunction with the lift platform. The first pair of bearings is operatively coupled to the first rail so as to enable the first pair of bearings to move with respect to the first rail. The second pair of bearings is operatively coupled to the second rail so as to enable the second pair of bearings to move with respect to the second rail.

In another aspect of the embodiments described herein, a pneumatic lifting device is provided. The device includes a base, a first mast attached to the base, and a second mast attached to the base opposite the first mast. The first mast has a first rail extending therealong, and the second mast has a second rail extending therealong. A first pair of bearings is operatively coupled to the first rail so to as be freely movable along the first rail. A third rail is operatively coupled to the first pair of bearings so as to move in conjunction with the first pair of bearings. A second pair of bearings is operatively coupled to the second rail so to as be freely movable along the second rail. A fourth rail is operatively coupled to the second pair of bearings so as to move in conjunction with the second pair of bearings. A third pair of bearings is operatively coupled to the third rail so to as be freely movable along the third rail. A fourth pair of bearings is operatively coupled to the fourth rail so to as be freely movable along the fourth rail. A lift platform is coupled to the third and fourth pairs of bearings so as to move in conjunction with the third and fourth pairs of bearings.

BRIEF DESCRIPTION OF THE DRAWINGS

FIG. 8A is a perspective view of a dual-rail structure incorporated into a particular embodiment of a lifting platform described herein, prior to activation of the lifting device.

FIG. 8B is the perspective view of FIG. 8A showing the dual-rail structure after activation of the lifting device and at full stroke or full extension.

DETAILED DESCRIPTION

The present disclosure describes embodiments of a lifting device designed to raise a person or object a certain distance above a floor or other surface on which the device rests. The embodiments of the lifting device described herein may be relatively compact, lightweight, and easily adaptable or expandable to provide a wide variety of stroke lengths and platform working heights. One embodiment of the device includes a base, a pair of masts mounted on the base, with a rail extending along each mast. A pair of bearings is operatively coupled to each rail so as to be movable along the rail. A working platform is attached to the bearings, which support the platform so that the platform can move along the rails. One or more inflatable bladders are positioned between the base and the platform. Inflation of the bladders moves the platform along the rails and in a direction away from the base, thereby lifting the platform.

In another embodiment, each mast includes a rail extending therealong as previously described. A first pair of bearings is also movably coupled to each rail so as to be movable along the rail as previously described. In addition, another rail is attached to the first pair of bearing so as to move in conjunction with the first pair of bearings. Also, a second pair of bearings is movably coupled to the other rail so as to be movable along the other rail. The platform is attached to the second pair of bearings. This enables an increase in the stroke length and platform height attainable using this embodiment.

Figure 1:
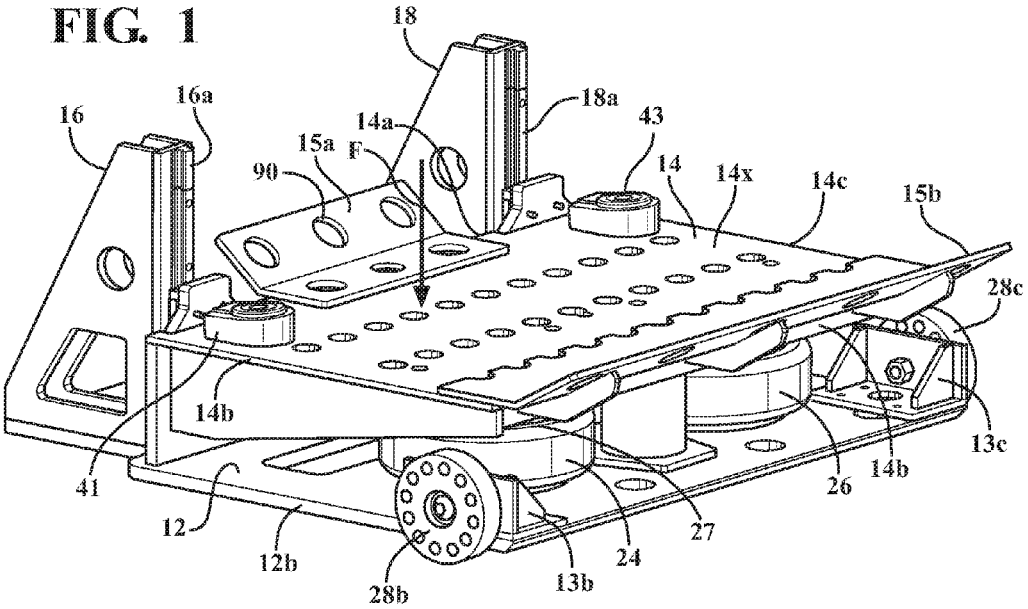
FIG. 1 shows a perspective view of a pneumatic lifting device in accordance with one embodiment described herein.
Figure 2:
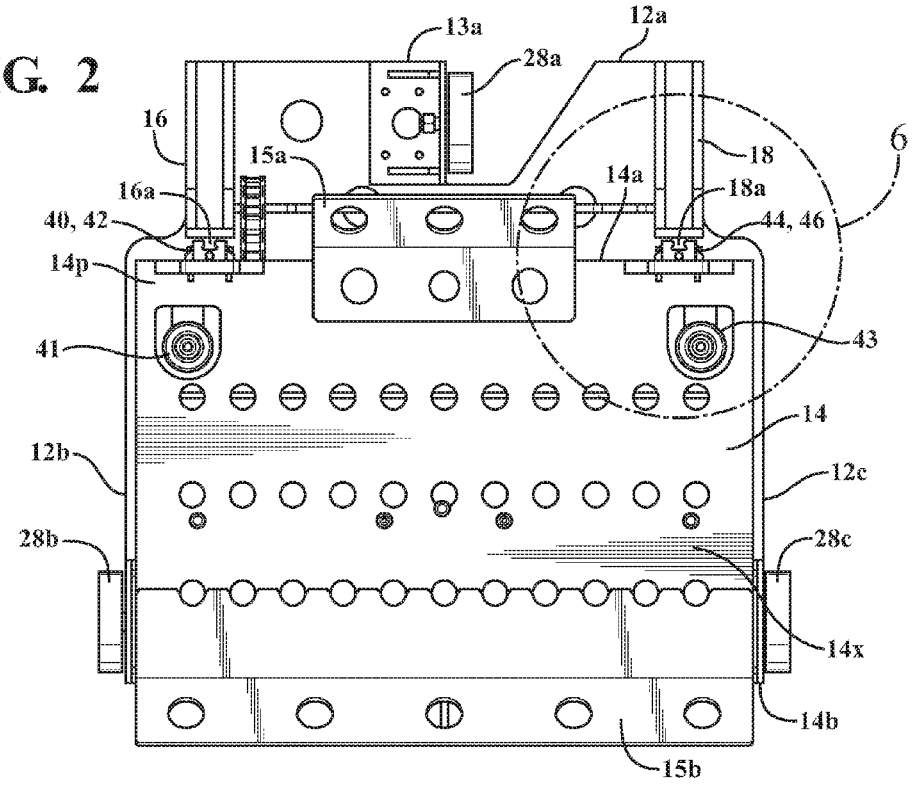
FIG. 2 shows a plan view of the embodiment shown in FIG. 1.

FIG. 1 shows a perspective view of one embodiment of a pneumatic lifting device, generally designated 10. The device 10 includes a base 12, a lift platform 14 which is operatively coupled to the base so as to be movable toward and away from the base 12, and one or more inflatable bladders 24, 26 positioned between the base 12 and the platform 14 for exerting a lifting force on the platform when inflated.

Base 12 may be generally flat to facilitate resting of the base on a floor or other flat support surface. In one embodiment, base 12 is formed from a flat plate shaped for enabling attachment of other elements of the lifting device thereto, as described herein. A plurality of brackets 13*a*, 13*b*, 13*c* is provided to enable attachment of associated wheels 28*a*, 28*b*, 28*c* to the base 12. Brackets 13*a*, 13*b*, 13*c* may be attached to base 12 using any suitable method, for example, welding or adhesive attachment. Alternatively, brackets 13*a*, 13*b*, 13*c* may be formed integrally with base 12 as a single piece.

The embodiment shown in FIGS. 1-7 includes three wheel brackets 13*a*, 13*b*, 13*c* attached to the base 12. Brackets 13*b* and 13*c* are positioned along second and third opposite sides 12*b* and 12*c* of the base. Bracket 13*a* is positioned along a first side 12*a* of the base 12 extending between second side 12*b* and third side 12*c*. In the embodiment shown in FIGS. 1-7, the wheel brackets 13*a*, 13*b*, 13*c* are positioned such that the wheels 28*a*, 28*b*, 28*c* form an essentially equilateral triangular arrangement when attached to the base 12, so as to distribute the loads carried by the wheels 28*a*, 28*b*, 28*c* as evenly as possible. However, other arrangements (such as an isosceles triangular arrangement or a rectangular arrangement, for example) are also possible.

Spaced-apart first and second masts 16 and 18, respectively, are attached to base 12 proximate base first side 12*a*. Masts 16 and 18 are operatively coupled to bearings attached to the platform 14 as described below, for maintaining rigidity and alignment of the platform during use. Masts 16 and 18 are attached to base 12 so as to extend substantially vertically when the wheels 28*a*, 28*b*, 28*c* are in contact with a floor. Masts 16 and 18 may be attached to the base using any suitable method, for example, welding, mechanical fasteners, etc. Mast 16 supports (or has formed therealong) an associated rail 16*a* structured for movably engaging and retaining thereon a pair of bearings 40 and 42 coupled to the lift platform 14 and designed to enable the platform to move freely along the mast 16. Mast 18 resides opposite mast 16 and supports (or has formed therealong) an associated rail 18*a* structured for movably engaging and retaining thereon a pair of bearings 44 and 46 coupled to the platform 14 and designed to enable the platform to move freely along the mast 18. Rails 16*a* and 18*a* may be provided with catches or hard stops (not shown) positioned at or near ends of the rails and configured to limit the extent of motion of the bearings along the rails, thereby effectively defining the stroke length of the lifting device.

Lift platform 14 has a flat central portion or support surface 14*x* structured to permit a worker to stand thereon (for example, when performing a factory assembly or maintenance operation). In a particular embodiment, the platform 14 may have attached thereto (or formed therealong) an upwardly-angled portion extending from at least one side or edge of the platform. The embodiment shown in FIGS. 1-7 includes a first angled portion 15*a* extending from a first side 14*a* of the platform 14, and a second angled portion 15*b* extending from a second side 14*b* of the platform 14 opposite the first side. Angled edge portions 15*a* and 15*b* are designed to serve as a haptic feedback mechanism informing the user of the positions of the associated edges of the platform, and to aid in preventing the user's feet from sliding off the platform. Angled edge portions 15*a* and 15*b* may be formed separately from the platform 14 and attached to the platform using any suitable means. Alternatively, the edge portions may be integrally formed with the platform, as a single piece.

A wall 14*r* (FIG. 4) extends from platform first side 14*a*. Wall 14*r* is structured for mounting thereon a plurality of bearings 40, 42, 44, 46 (described in greater detail below). First and second support brackets 14*s* and 14*t*, respectively, are coupled to (and connect) platform central portion 14*x* and wall 14*r*, to aid in stiffening and supporting the central portion 14*x*.

In the embodiment shown in FIGS. 1-7, a first pair of bearings 40, 42 are rigidly coupled to platform wall 14*r* so as to reside opposite mast 16. Also, a second pair of bearings 44, 46 is rigidly coupled to platform wall 14*r* so as to reside opposite mast 18. Bearings 40, 42, 44, 46 may be any bearings (for example, linear motion bearings) suitable for the purposes described herein. Bearings 40, 42 are structured to rollingly or otherwise engage rail 16*a* on mast 16, and bearings 44, 46 are structured to rollingly or otherwise engage rail 18*a* on mast 18 so as to enable the platform 14 to move freely along the rails 16*a* and 18*a*. Suppliers of linear motion bearings suitable for the applications described herein include, for example, Pcb Linear of Roscoe, Ill., and SKF USA of Lansdale, Pa.

In one embodiment, platform wall 14*r* is structured to permit the one of bearings 40, 42 located farthest from base 12 (in this case, bearing 40) to be attached to the wall 14*a* so that, when the bearing is operatively coupled to the associated rail 16*a*, at least a portion of the load bearing part of the bearing resides above a plane D (FIG. 4) defined by a portion 14*p* of the platform 14 extending from the wall 14*r* and through the bearing. In addition, the one of bearings 40, 42 located nearest to base 12 (in this case, bearing 42) resides below the plane D. Similarly, platform wall 14*r* is structured to permit the one of bearings 44, 46 located farthest from base 12 (in this case, bearing 44) to be attached to the wall 14*a* so that, when the bearing is operatively coupled to the associated rail 18*a*, at least a portion of the load bearing part of the bearing resides above the plane D. In addition, the one of bearings 44, 46 located nearest to base 12 (in this case, bearing 46) resides below the plane D.

Figure 5:
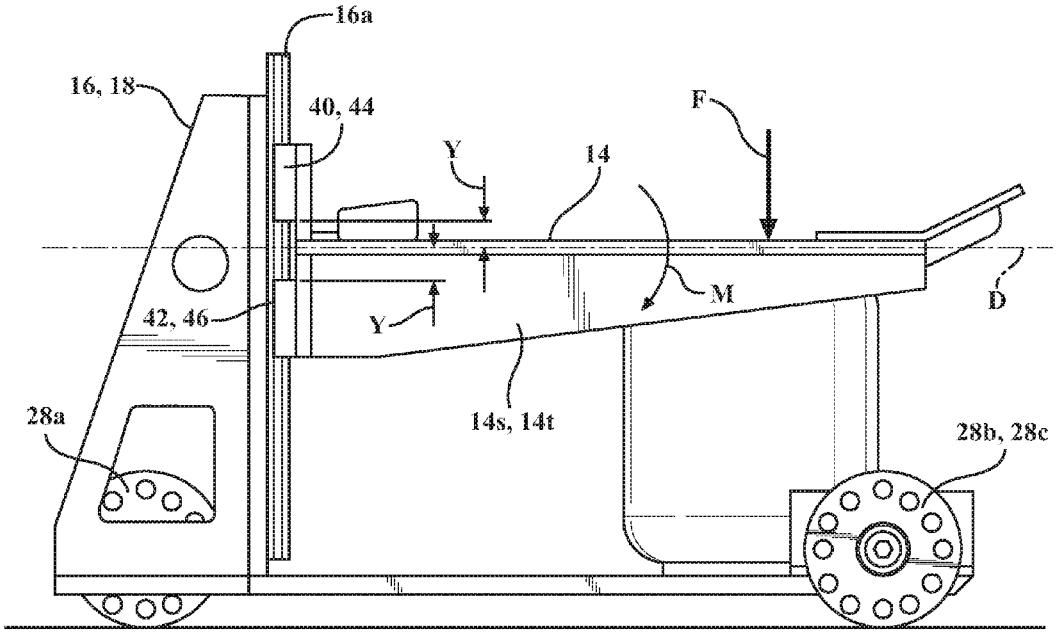
FIG. 5 is a schematic side view of a particular embodiment of the lifting device including a particular arrangement of the linear motion bearings.
Figure 6:
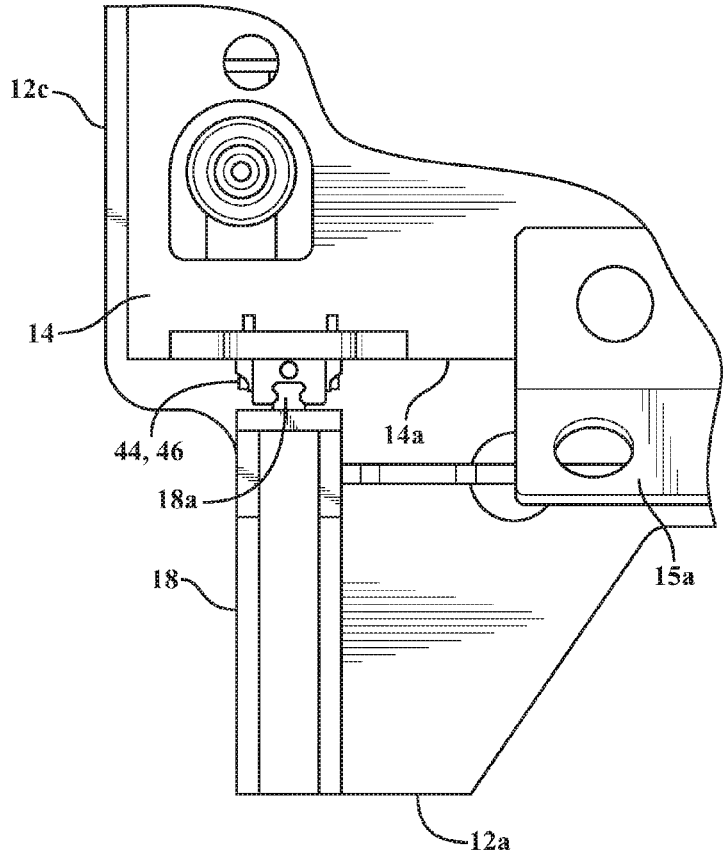
FIG. 6 is a magnified view of a portion of FIG. 2 showing engagement between platform bearings and an associated rail.

Referring to FIG. 5, in a particular embodiment, the bearing on each of rails 16*a*, 18*a* located farthest from base 12 is attached to the wall 14*a* so that the entire bearing resides above the plane D. In this embodiment, when a load F is applied to the working surface of the platform 14, the resulting moment M is resisted by bearings located both above and below the plane of application of the force F. The bearings above and below plane D may be located so that the closest regions of contact between the bearings and the associated rail are both at a distance Y from the plane D, as shown in FIG. 5.

Wheels 28*a*, 28*b*, 28*c* are structured and rotatably coupled to base 12 so as to enable transport of the lifting device by rolling along a floor or other flat surface. Each of wheels 28*a*, 28*b*, 28*c* has a wheel perimeter structured to make rolling contact with a floor or other surface along which the lifting device is to be moved. Each of wheels 28*a*, 28*b*, 28*c* also has a body portion residing between the perimeter and a center of the wheel.

Figure 7:
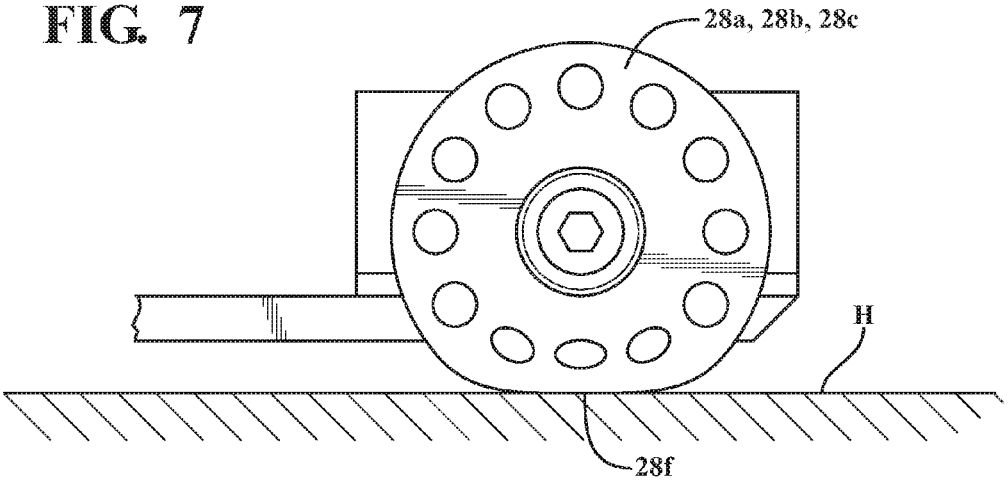
FIG. 7 is a schematic view showing deformation of a portion of a wheel in an embodiment of the lifting device.

In embodiments described herein, the wheels 28*a*, 28*b* are structured so that the wheels in combination support the weight of the lifting device above the floor and enable smooth rolling of the device during transport when the platform 14 is unloaded. Referring to FIG. 7, in a particular embodiment, the wheels are also structured such that the portion of each wheel in contact with the floor H may deform or flatten responsive to a load (such as bearing load F in FIG. 1) applied to the platform 14, thereby producing a flattened contact region 28*f*. This flattened contact region makes it difficult to roll the lifting device when the load is applied, thereby increasing platform stability when a user is standing on the platform 14 or when an object is resting on the platform. The wheels are also structured to return to an undeformed, cylindrical shape when the load is removed from the platform, thereby enabling the wheels to roll smoothly across the floor. Thus, in a particular embodiment, for the purposes described herein, each of the wheels 28*a*, 28*b*, 28*c* (or at least outer portions of the wheels including the wheel perimeters) may be structured from a suitably resilient material so as to have sufficient rigidity to support the weight of the lifting device above the floor and enable smooth rolling of the device during transport when the lifting device is unloaded, sufficient flexibility to deflect under the platform load so as to provide the flattened contact regions described, and sufficient resilience to return to an undeflected state when the platform load is removed. Alternatively, conventional non-deforming wheels may be used.

As shown in the drawings, body portions of the wheels 28*a*, 28*b*, 28*c* may have voids 28*v* formed therein to facilitate compression or flattening of the wheel during loading and to otherwise reduce the weight of the wheels. Design parameters (for example, the wheel material(s), the dimensions, shapes and/or arrangements of voids in the wheel body portions, and other pertinent parameters) needed to provide the features just described may be determined iteratively or analytically using known methods, given unloaded and loaded weights of the lifting device.

Any wheels or casters suitable for the purposes described herein may be used. In a particular embodiment, wheels 28*a*, 28*b*, 28*c* are structured and mounted to base 12 such that, when the platform is loaded, the portions of the wheels in contact with the floor deform to such a degree that the base makes contact with the floor or other surface on which the lifting device resides. This further increases the stability of the lifting device when loaded. Again, in this embodiment, when the load is removed from the platform, the resilient wheels return to undeformed states, thereby enabling the wheels to roll smoothly across the floor. Wheels usable for this purpose may be, for example, foam wheels obtainable from any of a variety of sources (for example, Servocity® of Winfield, Kans. (https://www.servocity.com))

Figure 3:
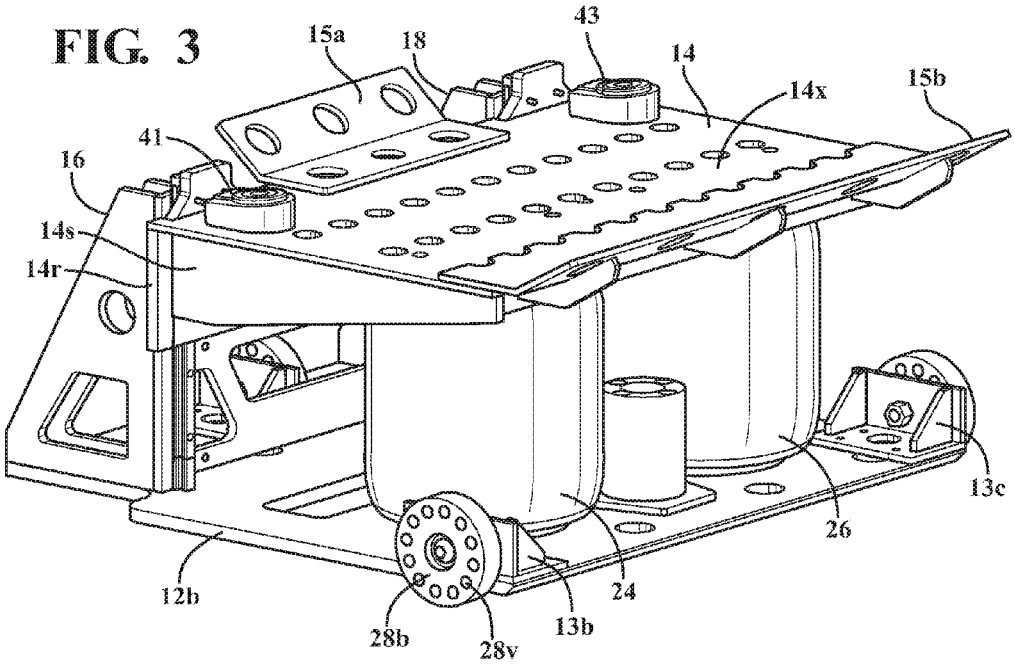
FIG. 3 is the perspective view of FIG. 1 after the inflatable bladders have been inflated to lift the platform.

Referring to FIGS. 1 and 3, one or more expandable air bladders 24 and 26 are provided for forcing platform 14 away from base 12 during inflation, thereby lifting the platform. The embodiments shown in FIGS. 1-10B incorporate a pair of bladders 24 and 26. However, a single bladder or more than two bladders may be used depending on the requirements of a particular lifting device design and application. For example, in the alternative embodiment shown in FIG. 11, two sets of stacked bladders 24A, 24B and 26A, 26B are used.

Figure 4:
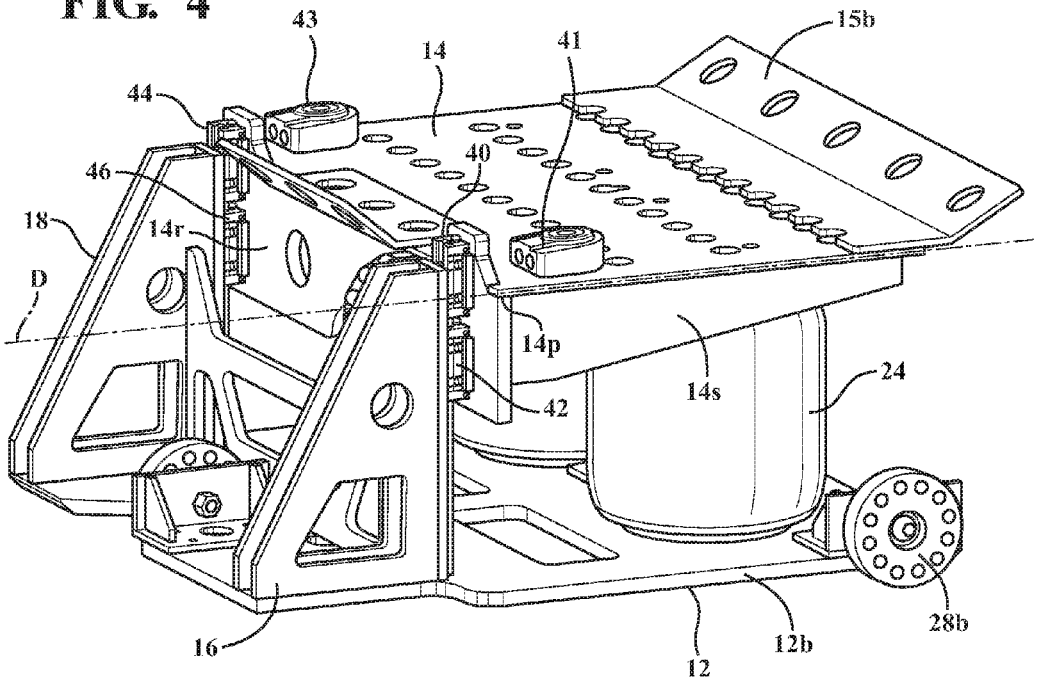
FIG. 4 is another perspective view of embodiment shown in FIG. 3
Figure 10A:
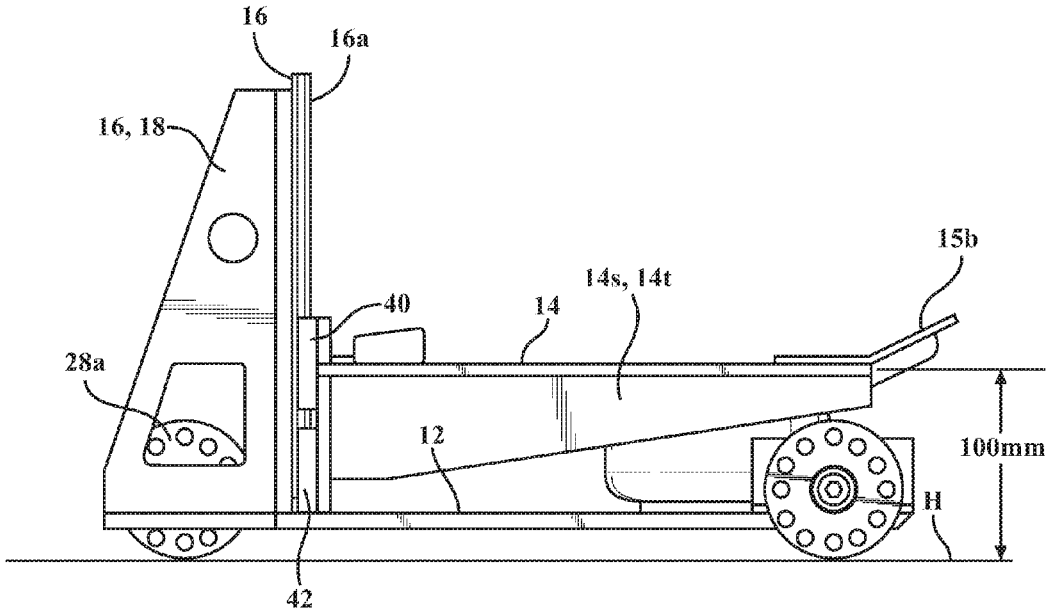
FIG. 10A shows a schematic side view of the lifting device embodiment shown in FIGS. 1-4 prior to activation of the device to inflate the bladders.
Figure 10B:
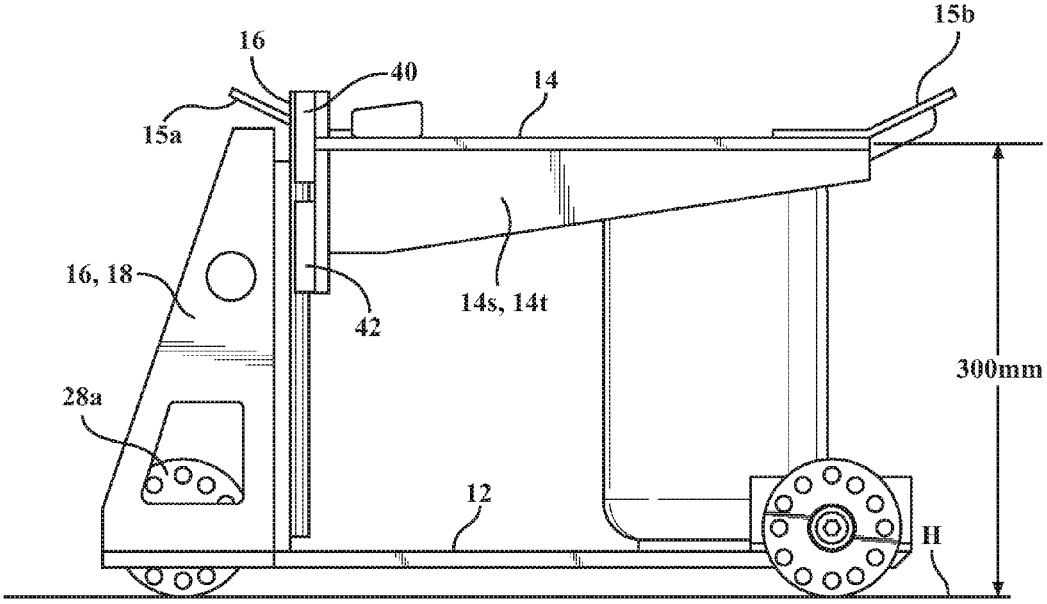
FIG. 10B shows the side view of FIG. 10A after inflation of the device to so as to provide full stroke or maximum platform height.
Figure 11:
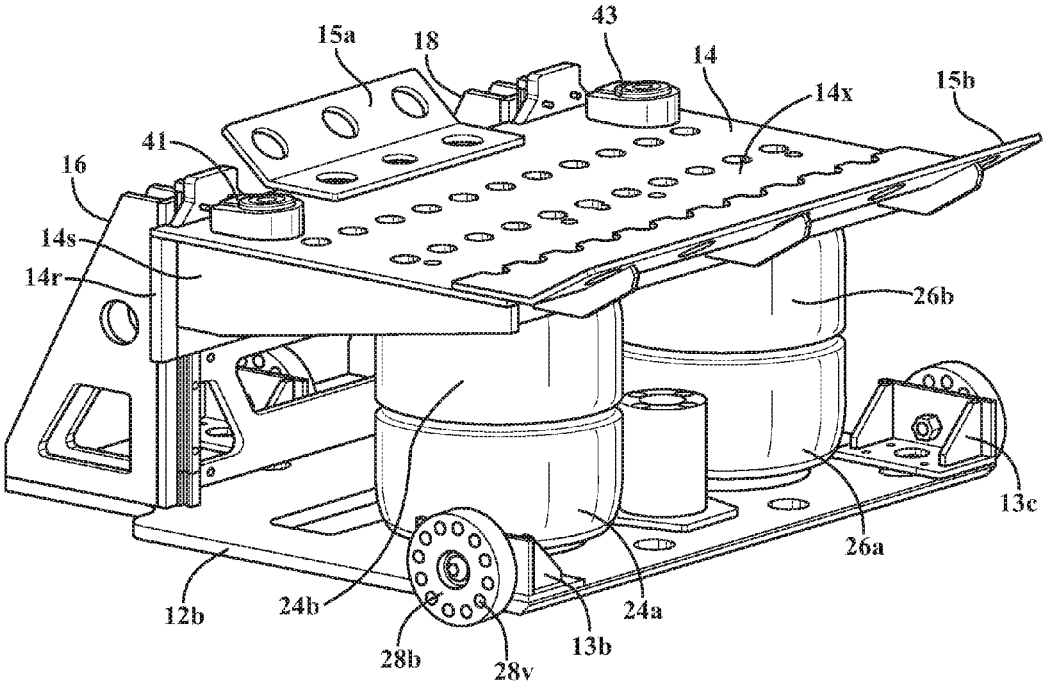
FIG. 11 is a perspective view of another embodiment of the lifting device using multiple stacked bladders, after the bladders have been inflated to lift the platform.

FIGS. 1 and 10B show an embodiment of the lifting device in a pre-activation configuration, prior to inflation of the bladders 24 and 26. In a particular embodiment (an example of which is shown in FIG. 10A), the support surface 14*x* resides about 100 millimeters from the floor surface H in the pre-activation configuration. FIGS. 3, 4 and 10B show the lifting device after the bladders 24 and 26 have been activated and the platform 14 raised to the full stroke length of the lifting device. In a particular embodiment (an example of which is shown in FIG. 10B), the full stroke length is 200 millimeters. Thus, at full stroke in this embodiment, the platform 14 resides at a height of about 300 millimeters from the floor surface.

In the embodiment shown in FIGS. 1-7, each of bladders 24 and 26 includes a platform contact member 27 positioned so as to be interposed between the platform 14 and the associated bladder. Contact members 27 aid in distributing the weight and loads of the platform on the bladders 24 and 26. In a particular embodiment, the contact members are structured and positioned so that the platform 14 rests on the contact members both prior to and during operation of the lift device by inflation of the bladders.

Inflation of the bladders 24 and 26 may be accomplished by a suitable electric pump or by a simple foot-operated bellows pump. The electric pump may be powered by a cord that connects to an external power source. The electric pump may also be foot-actuated. Inflation gas for the bladders may also come from other sources. Additional controls may include a hand or foot-actuated pressure relief valve (not shown) provided for releasing air from the bladders and lowering the platform 14. In a particular embodiment, the inflation controls are actuatable by a person standing on the platform 14. For example, in the embodiment shown in FIGS. 1-7, a first foot-accessible button 41 controlling raising of the platform 14 may be positioned on the support surface of the platform. Also, a second foot-accessible button 43 controlling lowering of the platform 14 may be positioned on the support surface of the platform opposite the first button 41. The air inflow into and out of the bladder(s) as controlled by these buttons may be regulated and attenuated to provide a relatively high degree of control over the bladder inflation and deflation rates, thereby controlling the resulting platform lift and descent rates.

Referring now to FIGS. 8A and 8B, in a particular embodiment, the masts 16 and 18 of the lifting device support a dual rail-construction which enables the stroke length of the lifting device to be greatly increased. FIGS. 8A and 8B show the coupling and operation of the dual rails. This dual-rail structure described below may also be applied to mast 18 previously described.

A first rail 16*a* is configured for attachment to (or formed as part of) a mast (not shown), such as mast 16 shown in FIG. 1, as previously described. In this embodiment, instead of bearings 40 and 42 being coupled to wall 14*a* of the platform 14, these bearings are coupled to a first side of a mounting member 121 by welding, fasteners, or any other suitable method. Otherwise, the bearings 40 and 42 engage the rail 16*a* so as to move freely along the rail as previously described. The bearings 40 and 42 are attached to the mounting member at or near what is the lowest end of the mounting member, in order to maximize the available stroke length in the structure described.

Because member 121 is attached to the bearings 40 and 42, the member 121 is also movable along rail 16*a* in conjunction with the bearings 40 and 42. In addition, a second rail 121*a* is attached to (or formed as part of) a second side of mounting member 121 opposite the first side. A pair of additional bearings 140 and 142 are mounted on rail 121*a* so as to be freely movable along and retained by the rail, in the manner previously described. Bearings 140 and 142 are connected to platform wall 14*r* in the manner previously described with regard to bearings 40 and 42 in FIG. 1. Hard stops (not shown) may be applied at opposite ends of rail 121*a* to limit the motion of the bearings 140 and 142 along rail 121*a*. Hard stops (not shown) may also be located at opposite ends of rail 16*a* to limit the motion of the bearings 40 and 42 along rail 121*a*.

Figure 9A:
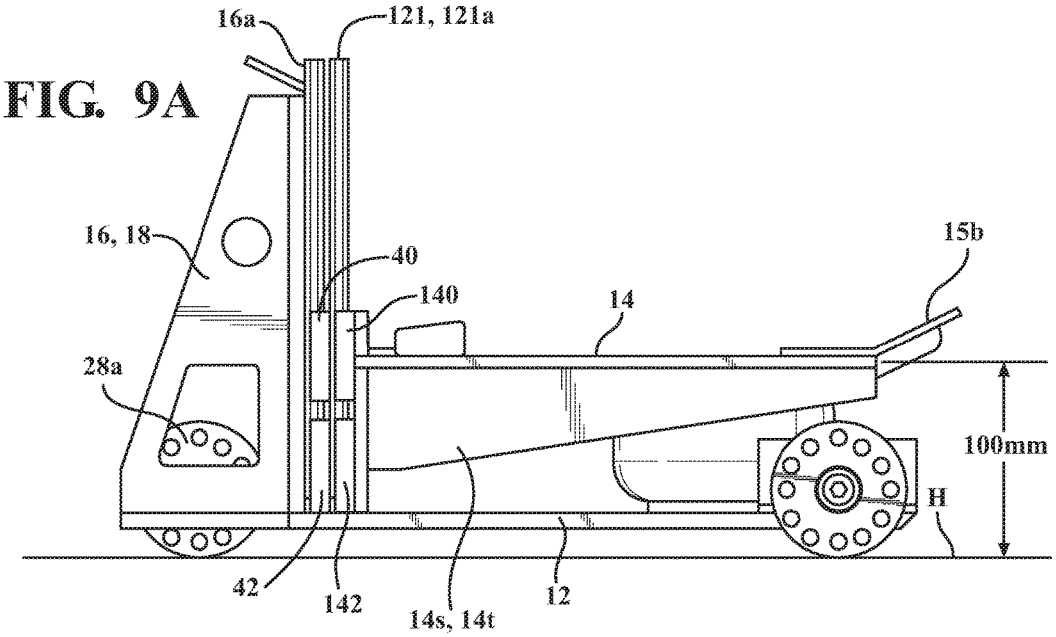
FIG. 9A is a schematic side view showing an embodiment of the lifting device with the dual-rail construction in the configuration shown in FIG. 8A, prior to activation of the device.
Figure 9B:
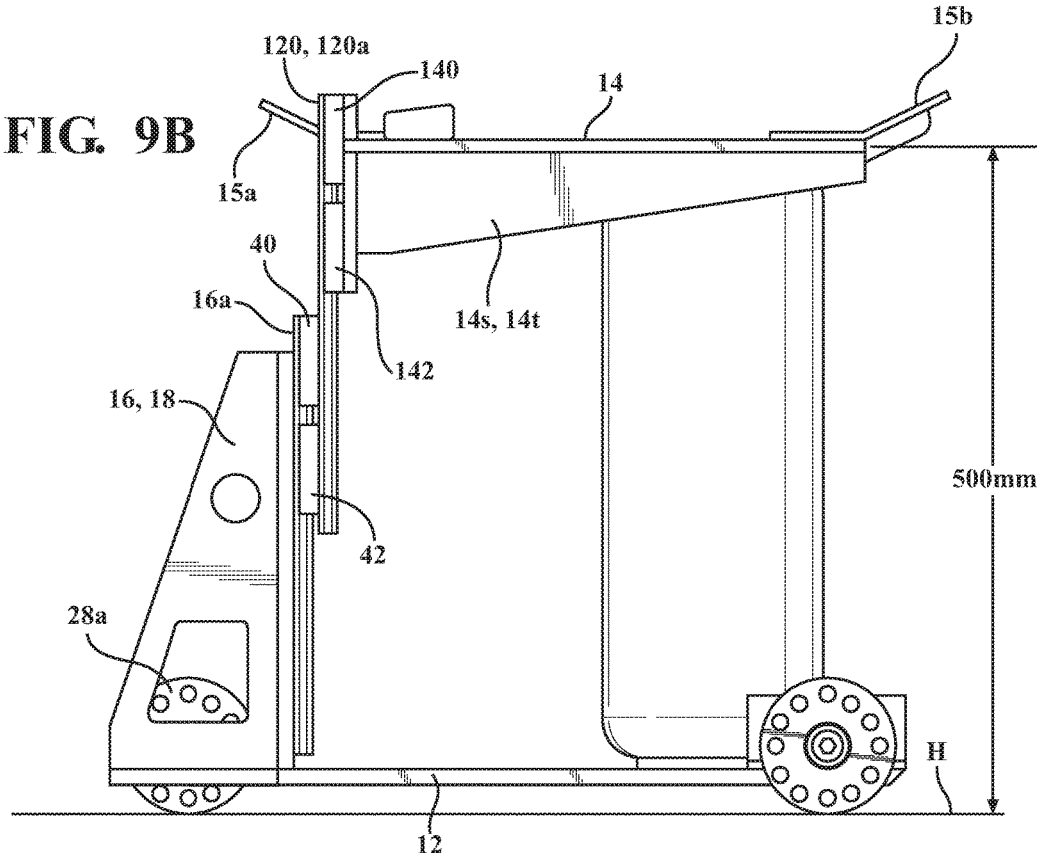
FIG. 9B is a schematic view showing the embodiment of FIG. 9A with the dual-rail construction in the configuration shown FIG. 8B, after activation of the device and with the device elevated to full stroke.

FIGS. 8A and 9A show the dual-rail construction prior to activation of the lifting device. Prior to activation, both sets of bearings 40, 42 and 140, 142 are at the ends of their respective rails closest to the floor H or resting surface of the lifting device. As the bladders inflate, bearings 40 and 42 move along rail 16*a*. Mounting member 121, which is rigidly attached to the bearings 40 and 42, moves in conjunction with the bearings. When the bearings reach the end of rail 16*a* as shown in FIG. 8B, the hard stop at the end of the rail prevents further motion of the bearings 40 and 42 along the rail 16*a*. However, as the bladders continue to expand, the platform 14 continues to rise. As the bearings 140 and 142 are attached to platform wall 14*r*, the bearings continue to move along rail 121*a* in direction AA, until they reach the hard stop at the end of rail 121*a*. FIGS. 8B and 9B show the dual-rail construction after the bladders have been inflated to raise the platform to the full stroke length of the lifting device.

FIG. 9A is a schematic side view showing an embodiment of the lifting device with the dual-rail construction in the configuration shown in FIG. 8A, prior to activation of the device. In a particular embodiment, the lifting device in FIG. 9A has a minimum platform height of 100 millimeters. FIG. 9B shows the embodiment of FIG. 9A with the dual-rail construction in the configuration shown FIG. 8B, after activation of the device and with the device elevated to full stroke. As seen in FIG. 9B, the dual-rail construction enables the maximum stroke length to be greatly extended. In a particular embodiment, the maximum platform height above the floor is increased to 500 millimeters, thus raising the stroke length to 400 mm.

It will be seen that the total stroke length and height that the platform 14 can reach is easily expandable from the configuration shown in FIGS. 1-6 by mounting on rail 16*a* bearings 40, 42 which have mounting member 121 and its associated rail 121*a* attached thereto. The bearings 140 and 142 are then coupled to the platform 14 in the manner previously described. This enables the additional bearings 140 and 142 to be mounted on rail 121*a*. Movement of bearings 140 and 142 along rail 121*a* combined with movement of bearings 40, 42 along rail 16*a* thus provides the additional stroke length and platform height previously described. In addition, a lifting device with the dual-rail construction described herein may provide additional stroke length and height capability in a design having the same, relatively small envelope size as a lifting device providing a smaller stroke length and available height. For example, the embodiment shown in FIG. 9B occupies essentially the same size envelope as the embodiment shown in FIG. 10B.

The various structural components of the lifting device may be formed from any suitable material or materials. For example, base 12, lift platform 14 and masts 16 and 18 may be formed from a metallic material (such as steel or aluminum), one or more polymers, or any other material or materials which provide the strength and rigidity needed for the purposes described herein. Voids and cavities (for example, void 90 in edge portion 15*a* in FIG. 1) may be formed where feasible in any of the structural elements of the lifting device, to aid in reducing the total weight of the device. The locations, number and sizes of voids and cavities that may be formed in the device components are determined by device structural design and requirements, such as strength and rigidity.

It should be understood that the preceding is merely a detailed description of various embodiments of this invention and that numerous changes to the disclosed embodiments can be made in accordance with the disclosure herein without departing from the spirit or scope of the invention. Thus, the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pneumatic lifting device comprising:

a base;

a first mast attached to the base, the first mast having a first rail extending therealong;

a second mast attached to the base opposite the first mast, the second mast having a second rail extending therealong; and a lift platform movably coupled to the first rail by a pair of bearings interposed between and separating the first rail and the lift platform, the pair of bearings coupling the lift platform to the first rail being mounted on the lift platform so as to move in conjunction with the lift platform, wherein the lift platform is also movably coupled to the second rail by a pair of bearings interposed between and separating the second rail and the lift platform, the pair of bearings coupling the lift platform to the second rail being mounted on the lift platform so as to move in conjunction with the lift platform, the pair of bearings coupling the lift platform to the first rail being operatively coupled to the first rail so as to enable the pair of bearings coupling the lift platform to the first rail to move with respect to the first rail, the pair of bearings coupling the lift platform to the second rail being operatively coupled to the second rail so as to enable the pair of bearings coupling the lift platform to the second rail to move with respect to the second rail, wherein a bearing of the pair of bearings coupling the lift platform to the first rail that is located farthest from the base is coupled to the lift platform so that, when the bearing is engaged with the first rail, at least a portion of a load-bearing part of the bearing resides above a plane defined by a portion of the lift platform and extending through the bearing, and wherein the other bearing of the pair of bearings coupling the lift platform to the first rail resides below the plane.

2. The device of claim 1 further comprising at least one inflatable bladder structured and positioned so as to force the lift platform in a direction away from the base during inflation, the at least one bladder including a contact member positioned between the platform and the at least one bladder and in contact with the lift platform.

3. The device of claim 1 further comprising a plurality of wheels rotatably coupled to the base wherein the plurality of wheels is structured to support a weight of the lifting device above a surface on which the lifting device resides when the platform is unloaded, and wherein each wheel of the plurality of wheels is structured such that a portion of the wheel in contact with the surface on which the lifting device resides may deform responsive to a load applied to the platform, thereby producing a flattened contact region structured to prevent rolling of the wheel when the load is applied to the platform.

4. The device of claim 1 wherein the pair of bearings coupling the lift platform to the first rail is positioned along a first edge of the lift platform, and wherein the lift platform includes an angled portion extending upwardly from the first edge of the lift platform.

5. The device of claim 4 wherein the lift platform further includes another angled portion extending upwardly from a second edge of the lift platform opposite the first edge.

6. The device of claim 3 wherein the wheels of the plurality of wheels are structured and mounted to the base such that, when the platform is loaded, portions of the wheels in contact with the surface on which the lifting device resides may deform so as to permit the base to make contact with the surface on which the lifting device resides.

7. The device of claim 1 wherein the pair of bearings coupling the lift platform to the first rail is operatively coupled to the first rail by a combination of:

another pair of bearings engaged with the first rail so as to enable the other pair of bearings to move along the first rail, and a third rail coupled to the other pair of bearings so as to move in conjunction with the other pair of bearings, the pair of bearings coupling the lift platform to the first rail being engaged with the third rail so as to enable the pair of bearings coupling the lift platform to the first rail to move along the third rail, the other pair of bearings being interposed between and separating the first rail and the third rail; and wherein the pair of bearings coupling the lift platform to the second rail is operatively coupled to the second rail by a combination of:

an additional pair of bearings engaged with the second rail so as to enable the additional pair of bearings to move along the second rail, and a fourth rail coupled to the additional pair of bearings so as to move in conjunction with the additional pair of bearings, the pair of bearings coupling the lift platform to the second rail being engaged with the fourth rail so as to enable the pair of bearings coupling the lift platform to the second rail to move along the fourth rail, the additional pair of bearings being interposed between and separating the second rail and the fourth rail.

8. A pneumatic lifting device comprising:

a base;

a first mast attached to the base, the first mast having a first rail extending therealong;

a second mast attached to the base opposite the first mast, the second mast having a second rail extending therealong;

a first pair of bearings engaged with the first rail so to as be freely movable along the first rail;

a third rail spaced apart from the first rail by the first pair of bearings and attached to the first pair of bearings so as to move in conjunction with the first pair of bearings;

a second pair of bearings engaged with the second rail so to as be freely movable along the second rail;

a fourth rail spaced apart from the second rail by the second pair of bearings and attached to the second pair of bearings so as to move in conjunction with the second pair of bearings;

a third pair of bearings engaged with the third rail so to as be freely movable along the third rail;

a fourth pair of bearings engaged with the fourth rail so to as be freely movable along the fourth rail; and a lift platform coupled to the third and fourth pairs of bearings so as to move in conjunction with the third and fourth pairs of bearings, wherein a bearing of the third pair of bearings that is located farthest from the base is coupled to the lift platform so that, when the bearing of the third pair of bearings is engaged with the third rail, at least a portion of a load-bearing part of the bearing of the third pair of bearings resides above a plane defined by a portion of the lift platform and extending through the bearing, and wherein the other bearing of the third pair of bearings resides below the plane.

9. The device of claim 8 further comprising a plurality of wheels rotatably coupled to the base, wherein the plurality of wheels is structured to support a weight of the lifting device above a surface on which the lifting device resides when the platform is unloaded, and wherein each wheel of the plurality of wheels is structured such that a portion of the wheel in contact with the surface may deform responsive to a load applied to the platform, thereby producing a flattened contact region structured to prevent rolling of the wheel when the load is applied to the platform.

10. The lifting device of claim 9, wherein the wheels of the plurality of wheels are structured and mounted to the base such that, when the platform is loaded, the wheels may deform so as to permit the base to make contact with the surface on which the lifting device resides.

11. The device of claim 8 wherein the first rail is structured to limit a motion of the third pair of bearings along the first rail, and the second rail is structured to limit a motion of the fourth pair of bearings along the second rail.

12. The device of claim 11 wherein the third rail is structured to limit a motion of the first pair of bearings along the third rail, and the fourth rail is structured to limit a motion of the second pair of bearings along the fourth rail.

* * * * *